United States Patent [19]

Barton

[11] 4,305,582

[45] Dec. 15, 1981

[54] ARTICULATIVELY SEGMENTED, ELONGATE AMUSEMENT DEVICE

[76] Inventor: Owen E. Barton, P.O. Box 875, Paonia, Colo. 81428

[21] Appl. No.: 126,193

[22] Filed: Mar. 3, 1980

[51] Int. Cl.[3] ..... A63B 71/04

[52] U.S. Cl. ..... 273/1 G; 272/67; 46/1 R

[58] Field of Search ..... 273/1 R, 84 R, 81 R, 273/157 R, 428; 272/67, 68, 75; 46/1 R, 152, 26, 24

[56] References Cited

U.S. PATENT DOCUMENTS

| | | | |
|---|---|---|---|
| 2,583,198 | 1/1952 | Axton, Jr. | 273/81 R X |
| 3,084,547 | 4/1963 | Nielsen | 272/68 X |
| 3,269,399 | 8/1966 | Smith | 273/81 R X |
| 3,597,872 | 8/1971 | Vennola et al. | 272/67 X |
| 3,861,683 | 1/1975 | Henry | 273/428 |
| 4,193,593 | 3/1980 | Wilson | 272/67 X |

*Primary Examiner*—Paul E. Shapiro
*Attorney, Agent, or Firm*—Mallinckrodt & Mallinckrodt

[57] ABSTRACT

An articulatively segmented, elongate bar, made up of relatively short and rectilinear sections which are normally maintained in end-to-end rectilinear alignment by a flexible and preferably elastic cord so as to be held and maneuvered in various ways to amuse both the maneuverer and onlookers, has its individual sections each constructed of a substantially rigid core, advantageously in the form of a lightweight tube, and a sleeve of soft and flexible material closely encompassing the core as a cushion, the ends of the section being symmetrical about the longitudinal axes of the respective sections and of mating character, so that, when the device is maneuvered, the sections will tip unpredictably relative to one another in various directions, and more or less so, depending upon the degree of and the manner in which motion is applied, without danger of harming the one holding and maneuvering the device.

9 Claims, 3 Drawing Figures

ARTICULATIVELY SEGMENTED, ELONGATE AMUSEMENT DEVICE

BACKGROUND OF THE INVENTION

1. Field:

The invention is in the field of amusement devices designed to be hand held and maneuvered by an individual to while the time away and as a demonstration of skill to himself and onlookers.

2. State of the Art:

There are a variety of amusement devices designed to be maneuvered by an individual as a test and demonstration of acquired skill, for example the sell known and so-called "Hula Hoop". Batons are often swung and twirled at parades to amuse onlookers. These, however, are not articulatively segmented to introduce an element of unpredictability to the result when movement is applied to one or more of the segments that are hand held.

OBJECTIVES

In the making of the present invention an objective was to provide a different kind of hand-held amusement device that, with skillful maneuvering, will provide pleasure for the user and will amuse onlookers. Further objectives were to provide for unpredictability of the result until considerable skill is acquired in the handling of the device, and to guard against injuries to the user if hit by portions of the device while acquiring maneuvering skill.

SUMMARY OF THE INVENTION

To accomplish the foregoing objectives, the device of the invention is constructed as an articulatively segmented, elongate bar having relatively short and preferably rectilinear sections normally maintained as an end-to-end series by a flexible cord, which is desirably of an elastic nature so as to normally hold the sections end against end in rectilinear alignment and to provide a spring action which will yield to external forces.

The individual sections are each constructed of a substantially rigid and lightweight core adapted to receive the flexible cord, and a sleeve of soft and flexible material closely encompassing the core as a cushion. The core is advantageously a length of lightweight tubing, such as convolute cardboard tubing. The ends of the sections are symmetrical transversely of the length, so that, when the device is maneuvered, the sections will tip unpredictably relative to one another in various directions, and more or less so, depending upon the degree of and the manner in which motion is applied. Due to the lightweight and cushioned nature of the sections, there is practically no danger of harm to the user even if he is hit by portions of the device during manipulation thereof.

THE DRAWING

An embodiment of the amusement device of the invention, that is presently contemplated as the best mode of carrying it out in actual practice, is illustrated in the accompanying drawing, in which:

FIG. 1 is a perspective view of the device in its normal condition waiting to be picked up and maneuvered;

FIG. 2, a longitudinal vertical section taken along the line 2—2 of FIG. 1, an intermediate portion being broken out for convenience of illustration; and FIG. 3, a pictorial view showing the device being hand-held and maneuvered, the normal and an alternate position assumed during the maneuvering being indicated by broken lines.

DETAILED DESCRIPTION OF THE ILLUSTRATED EMBODIMENT

Figure 1:
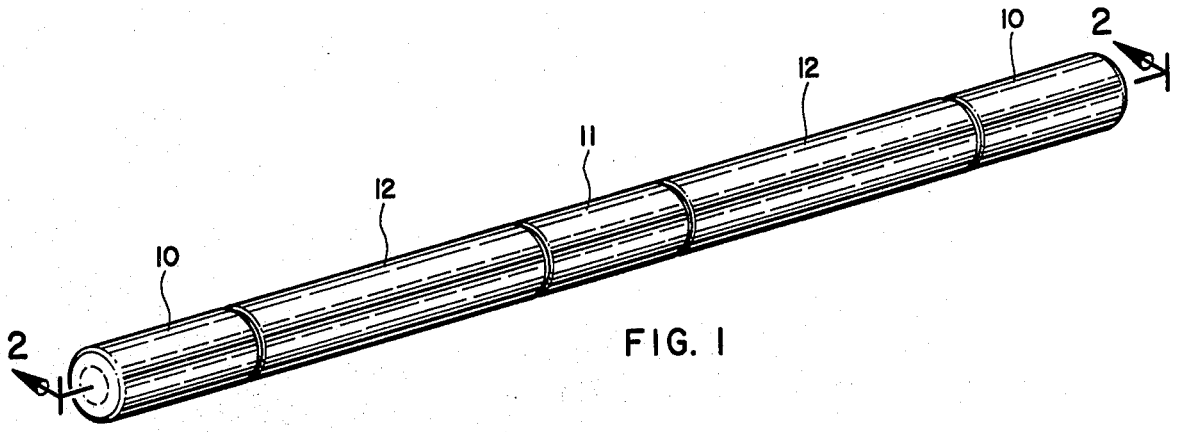
Figure 2:
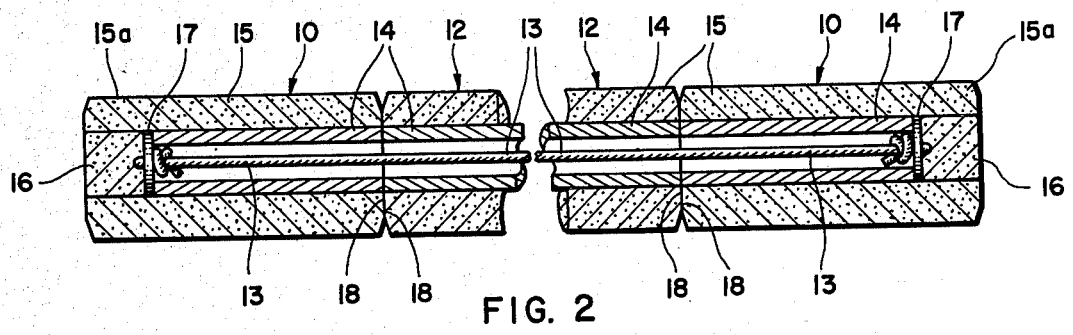

In the form illustrated, the device of the invention comprises a series of articulatively related, cylindrical sections, here shown as relatively short end sections 10 and intermediate section 11 and relative long intermediate sections 12, arranged end-to-end as an elongate bar.

It will be noted that each of the sections is relatively short in comparison with the total length of the bar, so that the bar can be maneuvered by a person holding one or more of the sections by hand.

The sections are normally maintained as an end-to-end serires by means of a flexible cord 13, which is preferably elastic in character so as to normally urge the sections tightly together in their end-to-end relationship as a continuous, rectilinear bar.

Although the individual sections may be constructed in various ways, with cord 13 extending axially through a substantially rigid core, it is important that they be cushioned exteriorly so as to safeguard the user of the device against injury in the event the unpredictable gyrations during maneuvering of the device cause one or more of the sections to hit the face or body of the user.

A most advantageous and preferred way of constructing the individual sections is by encompassing a length of substantially rigid but lightweight tubing 14 with a relatively thick sleeve 15 of soft and flexible material such as neoprene or similar sponge. The cushioning sleeve is preferably secured to the rigid tubing by a suitable adhesive.

The end sections 10 are desirably cushioned at their free and exposed ends by, for example, extending the cushioning sleeves 15 beyond the corresponding outside ends of the lengths of rigid tubing 14, as at 15*a*, and by inserting plugs 16 of similar cushioning material centrally of the respective outward sleeve extensions 15*a*. In this way, the opposite ends of cord 13 can be conveniently anchored in such end sections 10 by means of discs 17 which overlap the ends of the lengths 14 of rigid tubing associated with the end sections 10.

As illustrated, each of the several sections of the device have ends that are symmetrical about the longitudinal axes of the respective sections of the section, so that, when the device is maneuvered, the sections will tip unpredictably relative to one another in various directions, and more or less so, depending upon the degree of and the manner in which motion is applied. The strictly cylindrical nature of the several sections 10, 11, and 12 here shown inherently provides section ends that are symmetrical about the longitudinal axes of such sections. However, such ends could be variously formed and still adhere to the symmetrical requirement. Thus, the end surfaces 18, instead of being flat and perpendicular to the longitudinal axes of the sections, could be conical or annularly ridged for example, so long as there is mating of contiguous ends in order to preserve the continuous bar nature of the device.

Figure 3:
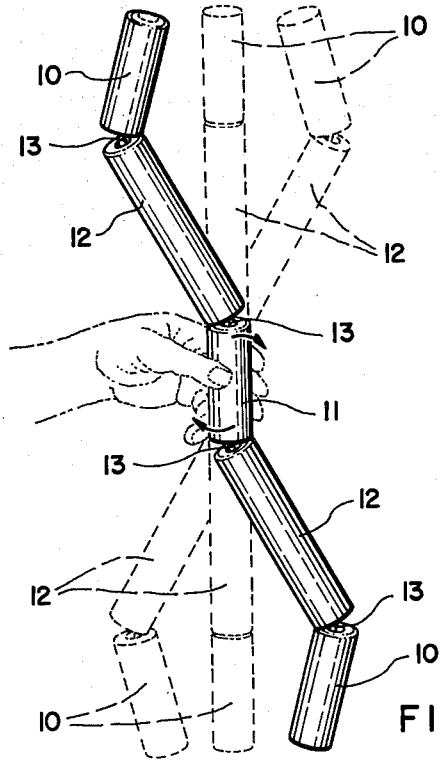

FIG. 3 illustrates one way in which the articulatively segmented elongate amusement device of the invention can be held and maneuvered for the entertainment of the user and of onlookers, should there be onlookers. The device may be shaken, twirled, twisted, and maneuvered in diverse other ways limited only by the imagination of the user.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. An articulatively segmented, elongate amusement device, comprising a series of articulatively related sections arranged end-to-end as an elongate bar, each section being relatively short in comparison with the total length of the bar so that the bar can be maneuvered by a person hand-holding one or more of the sections; and a flexible cord extending axially through said sections for normally maintaining the sections as an end-to-end series; each of said sections being constructed with a substantially rigid core through which the cord extends and a relatively thick sleeve of soft and flexible material closely encompassing the core as a cushion, the adjoining ends of each of mutually adjoining sections being symmetrical about the longitudinal axes of the respective sections and of mating character so that, when the device is maneuvered, the sections will tip unpredictably relative to one another in various directions, and more or less so, depending upon the degree of and the manner in which motion is applied, without danger of harming the person holding and maneuvering the device.

2. An amusement device according to claim 1, wherein the core of each section is a length of lightweight tubing.

3. An amusement device according to claim 1, wherein the flexible cord is elastic in nature so the bar sections will be held with ends tightly contiguous in rectilinear bar formation.

4. An amusement device according to claim 1, wherein the cushioning sleeve is of elastomer sponge material.

5. An amusement device according to claim 4, wherein the endmost sections have the respective cores terminating short of the free, outside ends of said sections and the respective cushioning sleeves extending beyond and covering the outside ends of the respective cores.

6. An amusement device according to claim 5, wherein the outside ends of the respective cores are provided with transverse structure in which the respective ends of the flexible cord are anchored.

7. An amusement device according to claim 5, wherein respective plugs of cushioning material are inserted in the outside ends of the cushioning sleeves.

8. An amusement device according to claim 1, wherein the core of each section is a length of convolute cardboard tubing.

9. An articulatively segmented, elongate amusement device, comprising a series of articulatively related sections arranged end-to-end as an elongate bar, each section being relatively short in comparison with the total length of the bar so that the bar can be maneuvered by a person hand-holding one or more of the sections; and a flexible cord extending axially through said sections for normally maintaining the sections as an end-to-end series; each of said sections being constructed with a substantially rigid core through which the cord extends and a relatively thick sleeve of soft and flexible material closely encompassing the core as a cushion, the adjoining ends of mutually adjoining sections being flat and at right angles to the length axis of the section so that, when the device is maneuvered, the sections will tip unpredictably relative to one another in various directions, and more or less so, depending upon the degree of and the manner in which motion is applied, without danger of harming the person holding and maneuvering the device.

* * * * *